US012805632B2

(12) United States Patent
Ang et al.

(10) Patent No.: US 12,805,632 B2
(45) Date of Patent: Nov. 24, 2026

(54) DAMPING AND REBOUNDING SLIDING RAIL AND DRAWER ASSEMBLY HAVING SAME

(71) Applicant: FOSHAN TIANSI HARDWARE CO., LTD., Foshan (CN)

(72) Inventors: Xian Poh Ang, Foshan (CN); Qingjun Lao, Foshan (CN)

(73) Assignee: FOSHAN TIANSI HARDWARE CO., LTD., Foshan (CN)

( * ) Notice: Subject to any disclaimer, the term of this patent is extended or adjusted under 35 U.S.C. 154(b) by 89 days.

(21) Appl. No.: 19/006,256

(22) Filed: Dec. 31, 2024

(65) Prior Publication Data

US 2025/0127298 A1 Apr. 24, 2025

Related U.S. Application Data

(63) Continuation of application No. PCT/CN2023/094649, filed on May 17, 2023.

(30) Foreign Application Priority Data

Jul. 20, 2022 (CN) ..... 202210852908.X

(51) Int. Cl.
*A47B 88/477* (2017.01)
*A47B 88/49* (2017.01)

(52) U.S. Cl.
CPC ..... *A47B 88/477* (2017.01); *A47B 88/49* (2017.01)

(58) Field of Classification Search
CPC ..... A47B 88/477; A47B 88/49; A47B 88/46
See application file for complete search history.

(56) References Cited

U.S. PATENT DOCUMENTS

| | | | | |
|---|---|---|---|---|
| 10,973,322 | B1 * | 4/2021 | Chen | A47B 88/493 |
| 2011/0001412 | A1 * | 1/2011 | Zimmermann | A47B 88/467 312/334.12 |
| 2019/0216219 | A1 * | 7/2019 | Chen | A47B 88/407 |
| 2021/0052073 | A1 * | 2/2021 | Chen | A47B 88/50 |
| 2021/0120951 | A1 * | 4/2021 | Chen | A47B 88/57 |
| 2025/0204682 | A1 * | 6/2025 | Chen | A47B 88/57 |
| 2025/0215924 | A1 * | 7/2025 | Lin | A47B 88/57 |

FOREIGN PATENT DOCUMENTS

| | | | |
|---|---|---|---|
| CN | 111677394 | A | 9/2020 |
| CN | 111728401 | A | 10/2020 |
| CN | 218164629 | U | 12/2022 |

OTHER PUBLICATIONS

International Search Report of PCT Patent Application No. PCT/CN2023/094649 issued on Aug. 19, 2023.

* cited by examiner

*Primary Examiner* — Daniel J Rohrhoff

(57) ABSTRACT

Disclosed in the present disclosure is a damping and rebounding sliding rail, including an outer rail, an inner rail slidably arranged within the outer rail, a damping device arranged at an end of the outer rail, and a rebound device, it is capable of causing the inner rail to slide with damping and synchronously compressing the rebound device when the inner rail is pushed to slide relative to the outer rail until the inner rail is close to the damping device, under the action of the damping device; then the inner rail is pushed again in the same direction, and the rebound device releases elastic force and drives the inner rail to slide in an opposite direction to achieve pop-up.

16 Claims, 11 Drawing Sheets

DAMPING AND REBOUNDING SLIDING RAIL AND DRAWER ASSEMBLY HAVING SAME

CROSS-REFERENCE TO RELATED APPLICATIONS

The present application is a Continuation Application of PCT Application No. PCT/CN2023/094649 filed on May 17, 2023, which claims priority of Chinese Patent Applications No. 202210852908X filed on Jul. 20, 2022 before CNIPA. All the above are hereby incorporated by reference in their entirety as part of the present disclosure.

TECHNICAL FIELD

The present disclosure relates to the technical field of hardware accessories and, particularly, to a damping and rebounding sliding rail and a drawer assembly having the same.

BACKGROUND

In order to improve the ease of switching operation of the sliding rail, there are many functional accessories applied to the sliding rail on the market, such as a damper for buffering the sliding rail or a rebound device for pressing the sliding rail to bounce open. The sliding rail with only a damper can be buffered and closed until the sliding rail is completely closed after the sliding rail is closed to a certain extent. However, when the sliding rail is opened, the sliding rail needs to be pulled out by hand to store energy for the damper. Therefore, it is necessary to provide a handle structure on the panel of a drawer or cabinet or the like to facilitate manual pulling out. The slide rail with a rebound device only can be unlocked and rebounded by pressing the sliding rail, but when the sliding rail is closed to a certain extent, it is necessary to manually press the sliding rail again to achieve complete closure of the sliding rail and synchronously realize the energy storage and lock of the rebound device, which is cumbersome to operate.

Therefore, how to achieve the function of damping closure and pressing rebound on a set of sliding rails at the same time is an urgent technical problem to be solved for those skilled in the art.

SUMMARY

In order to overcome the aforementioned disadvantages in the prior art, provided in the present disclosure is a damping and rebounding sliding rail, which not only realizes the damping closure and pressing rebound function, but also synchronously compresses the rebound device to store energy during the damping closure of the sliding rail, saving time and labor.

The technical solutions adopted by the present disclosure to solve the problems are:

A damping and rebounding sliding rail, including:

an outer rail;

an inner rail, slidably disposed within the outer rail;

a damping device, disposed at an end of the outer rail; and a rebound device, in which, when the inner rail is pushed to slide relative to the outer rail until the inner rail is close to the damping device, the inner rail is capable of being driven to slide with damping and synchronously compressing the rebound device under the action of the damping device, then the inner rail is pushed again in the same direction, and the rebound device releases elastic force and drives the inner rail to slide in an opposite direction to achieve pop-up.

The damping and rebounding sliding rail of the present disclosure not only realizes the function of damping closure and pressing rebound, but also synchronously compresses the rebound device for energy storage during the process of damping closure of the inner rail. When the inner rail needs to be opened, it can be bounced open by simply pressing the inner rail again. The entire operation process is simple and convenient, saving time and labor.

Further, the damping device includes:

a fixing bracket, fixedly disposed at an end of the outer rail;

a sliding bracket, slidably disposed within the outer rail and slidable in a direction proximal to or distal to the fixing bracket;

a damping member, disposed on the fixing bracket or the sliding bracket;

a tension member, disposed between the fixing bracket and the sliding bracket, configured to pull the sliding bracket to slide in the direction proximal to the fixing bracket.

Specifically, the tension member is a spring.

Thus, under the action of the tension member, the sliding bracket can be driven to slide in a direction proximal to the fixing bracket, and the sliding with damping can be achieved under the action of the damping member.

Further, the sliding bracket is rotatably connected with a first limit member; the fixing bracket is provided with a first chute for insertion of the first limit member, the first chute including a straight groove segment and a first bent segment communicating with an end of the straight groove segment.

Thus, when the first limit member is located on the first bent segment, the sliding bracket is distal to the fixing bracket and is in the locking state, the tension member is stretched; when the first limit member is driven out of the first bent segment and enters the straight groove segment, the sliding bracket is unlocked and under the action of the tension member, the sliding bracket is driven to slide along the straight groove segment and gradually approach the fixing bracket.

Further, a first snap block is provided at an end of the inner rail proximal to the damping device, a first guide groove configured to guide the first limit member out of the first bent segment and into the straight groove segment is provided on the first snap block, and a first protruding block abutted against the first limit member is provided in the first guide groove.

Further, the first guide groove includes a first guide segment extended horizontally and a second guide segment connected with the first guide segment and bent in shape.

Thus, when the inner rail is pushed to slide until it is close to the damping device, the first limit member slides into the first guide groove and along the first guide segment until the first limit member slides into the second guide segment, under the guidance of the second guide segment, the first limit member disengages the first bent segment and enters the straight groove segment, and then under the action of the tension member, the first limit member is abutted against the first protruding block and drives the first protruding block to slide along the straight groove segment.

Further, the rebound device includes a slider slidably provided on the fixing bracket and an elastic member connected with the slider, the slider penetrates out of the sliding bracket, and a second snap block abutted against and cooperated with the slider is provided at an end of the inner rail proximal to the damping device.

Thus, under the action of the tension member, the first limit member drives the inner rail to slide with damping, and the second snap block is abutted against the slider and drives the slider to move to stretch the elastic member, thereby realizing the energy storage of the rebound device.

Further, the first chute further includes a second bent segment in communication with an opposite end of the straight groove segment, and a bending direction of the second bent segment is opposite to a bending direction of the first bent segment.

Thus, when the inner rail is pushed to slide again in the direction proximal to the fixing bracket, under the action of the second guide segment, the first limit member disengages from the straight groove segment until entering the second bent segment, at which time the first limit member is separated from the first protruding block, and under the action of the elastic member, the slider can be abutted against the second limit member and slide in a direction distal to the fixing bracket to achieve pop-up.

Further, an abutment surface configured to be abutted against the first limit member is provided at an end of the second snap block distal to the fixing bracket; a first guide surface configured to guide the first limit member from the second bent segment entering the straight groove segment is disposed between the second bent segment and the straight groove segment; and a second guide surface configured to guide the first limit member from the straight groove segment entering the first bent segment is disposed between the straight groove segment and the first bent segment.

Thus, when the sliding rail is completely pulled out, the second snap block is abutted against the first limit member and drive the first limit member to slide, thereby driving the sliding bracket to slide in a direction distal to the fixing bracket and synchronously stretch the tension member. Under the guidance of the first guide surface, the first limit member can slide into the straight groove segment from the second bent segment, and then slide along the straight groove segment and under the guidance of the second guide surface until slide into the first bent segment, the sliding bracket is now locked and the energy storage of the damping device is completed, the second snap block is separated from the first limit member, and then the sliding rail can be further pulled outward.

Further, the rebound device further includes a second limit member rotatably connected to the fixing bracket and extending out of the sliding bracket, a second guide groove provided on the first snap block, and a second protruding block provided on the second guide groove, and the second protruding block is provided with a notch snap-fitted with the second limit member.

Further, the first snap block is further provided with a third guide groove and a third protruding block disposed in the third guide groove, and the third protruding block is configured to guide the second limit member from the third guide groove entering the second guide groove.

Thus, when the inner rail is pushed to slide until being close to the damping device, the second limit member can slide into the third guide groove, and then the second limit member can slide into the second guide groove from the third guide groove under the guidance of the third protruding block when the inner rail is pressed and popped out. The sliding rail is pressed subsequently again, the second limit member can slide along the second guide groove and is snap-fitted with the notch on the second protruding block to achieve locking of the inner rail.

Further, the damping member is a telescopic cylinder provided on the sliding bracket, the fixing bracket is provided with at least one limit rail and a side wall of the limit rail is inclined from a direction distal to the fixing bracket to a direction proximal to the fixing bracket, and a telescopic end of the telescopic cylinder is abutted against and cooperated with the side wall of the limit rail.

Thus, the side wall of the limiting rail is abutted with the telescopic end of the telescopic cylinder, and it can be converted into a resistance to the retraction of the tension member when the sliding bracket slides in a direction close to the fixing bracket, thereby achieving a damping effect.

In addition, provided in the present disclosure is further a drawer assembly, including a drawer and the aforementioned damping and rebounding sliding rail arranged on the left and right sides of the drawer.

In summary, disclosed in the present disclosure is a damping and rebounding sliding rail and a drawer assembly including the same, the damping and rebounding sliding rail not only realizes the function of damping closure and pressing rebound at the same time, but also synchronously compresses the rebound device for energy storage during the process of damping closure of the inner rail. When the inner rail needs to be opened, it can be bounced open by simply pressing the inner rail again. The entire operation process is simple and convenient, saving time and labor.

Figure 1:
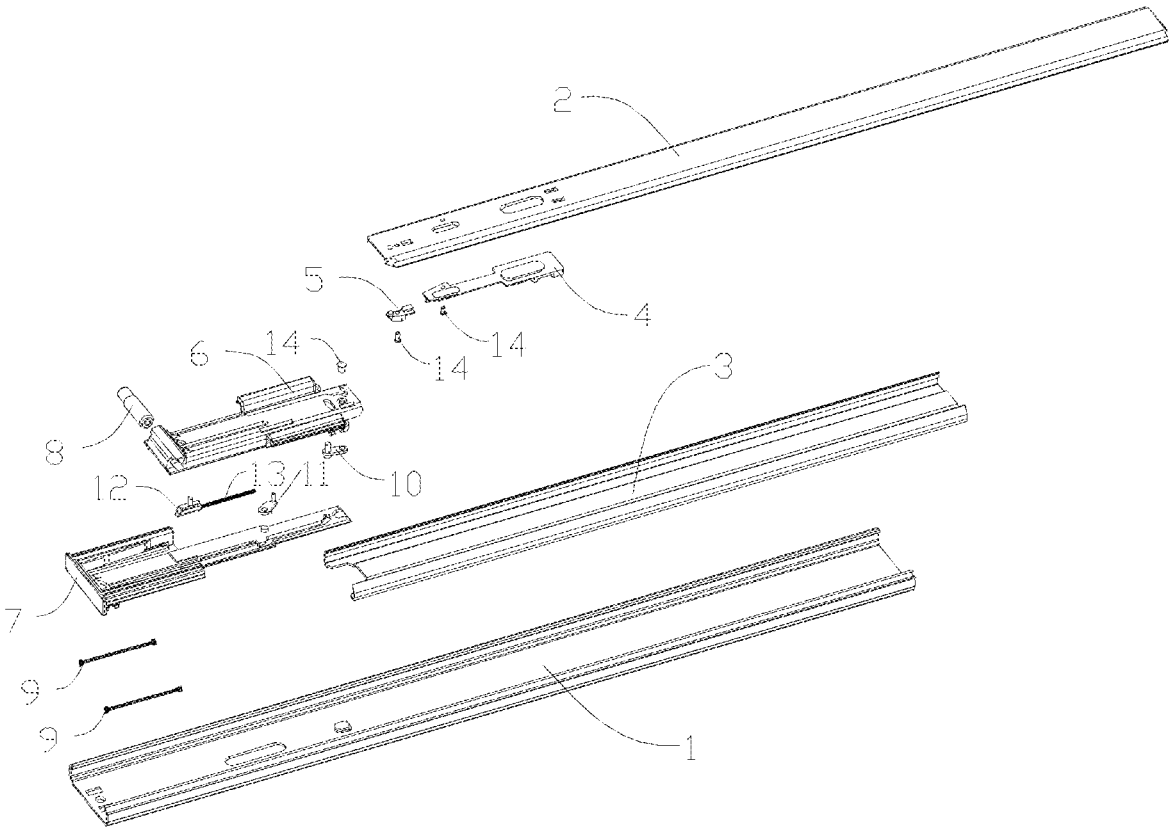
FIG. 1 is a schematic exploded diagram of a damping and rebounding sliding rail of the present disclosure.
Figure 2:
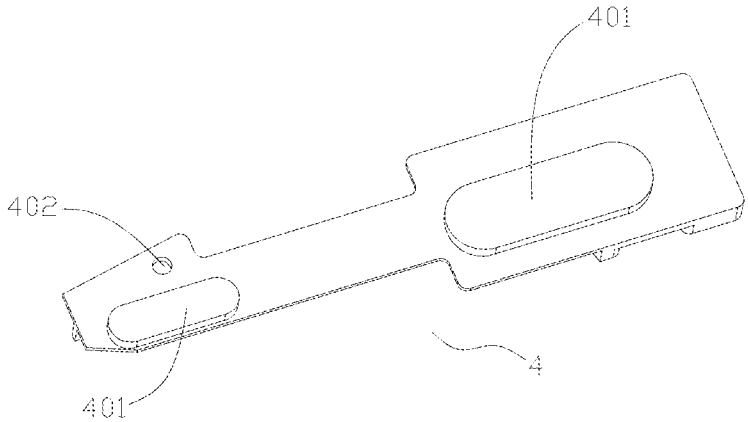
FIG. 2 is a schematic structural diagram of the first snap block in the damping and rebounding sliding rail of the present disclosure.
Figure 3:
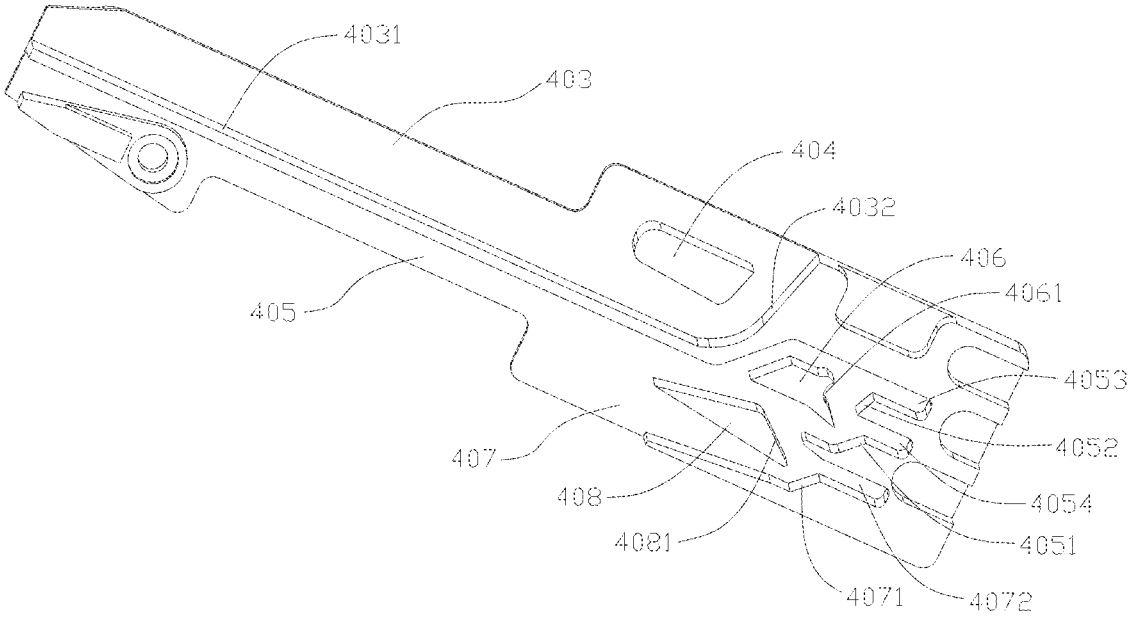
FIG. 3 is a schematic structural diagram of another view of the first snap block in the damping and rebounding sliding rail of the present disclosure.
Figure 4:
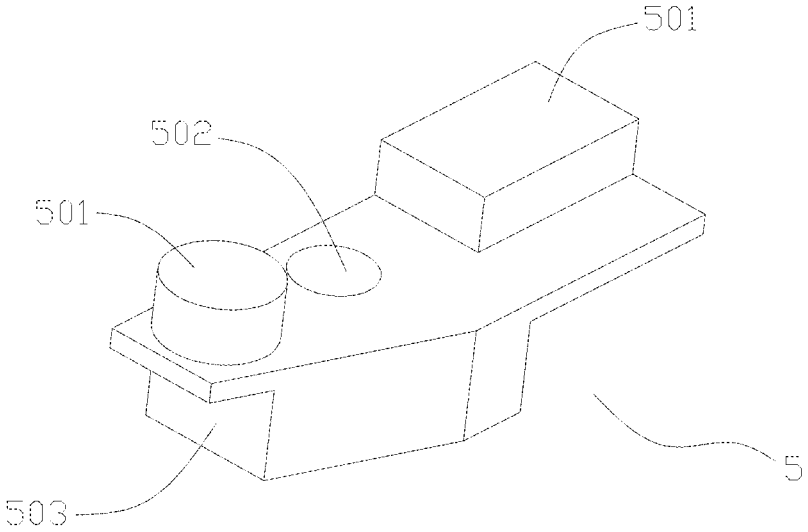
FIG. 4 is a schematic structural diagram of the second snap block in the damping and rebounding sliding rail of the present disclosure.
Figure 5:
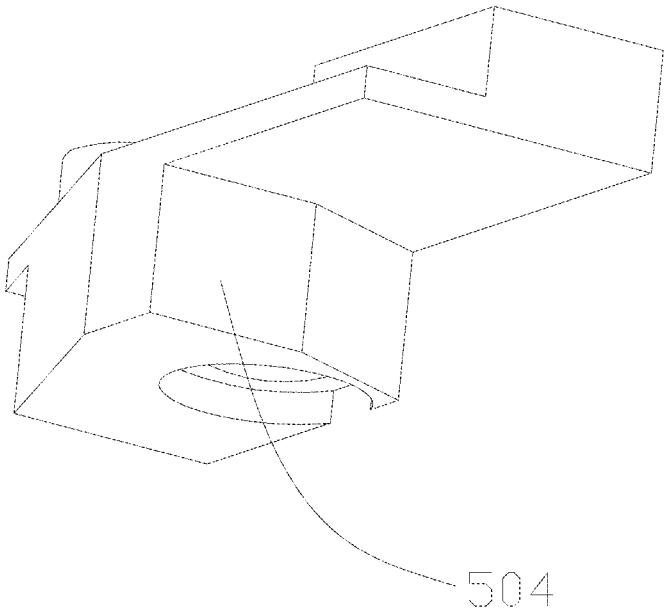
FIG. 5 is a schematic structural diagram of another view of the second snap block in the damping and rebounding sliding rail of the present disclosure.
Figure 6:
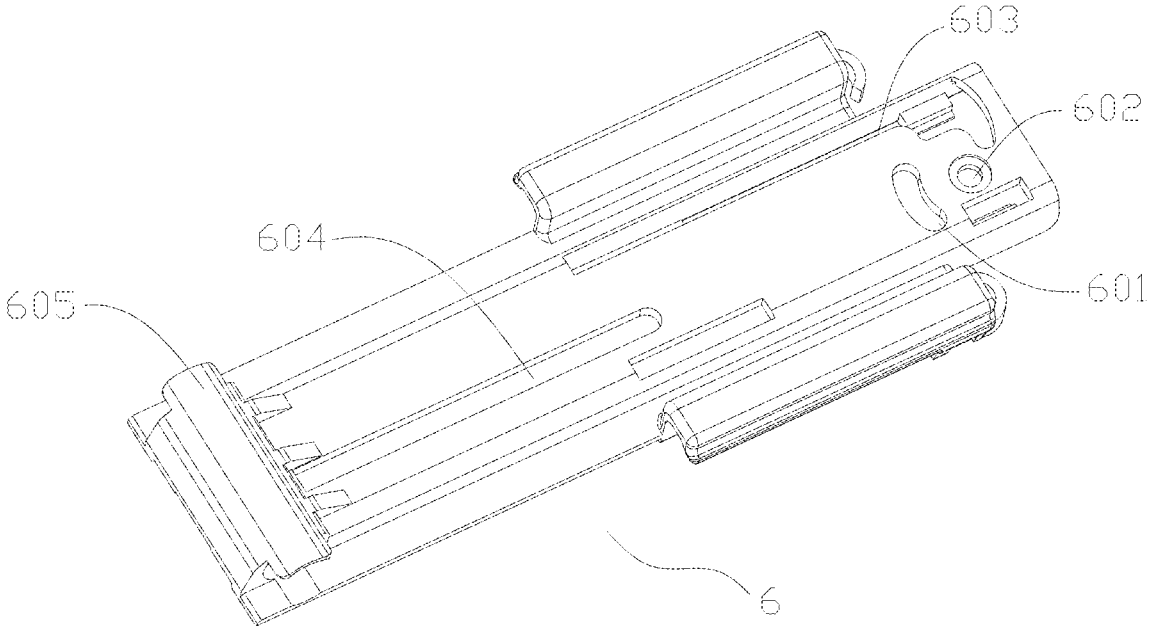
FIG. 6 is a schematic structural diagram of the sliding bracket in the damping and rebounding sliding rail of the present disclosure.
Figure 7:
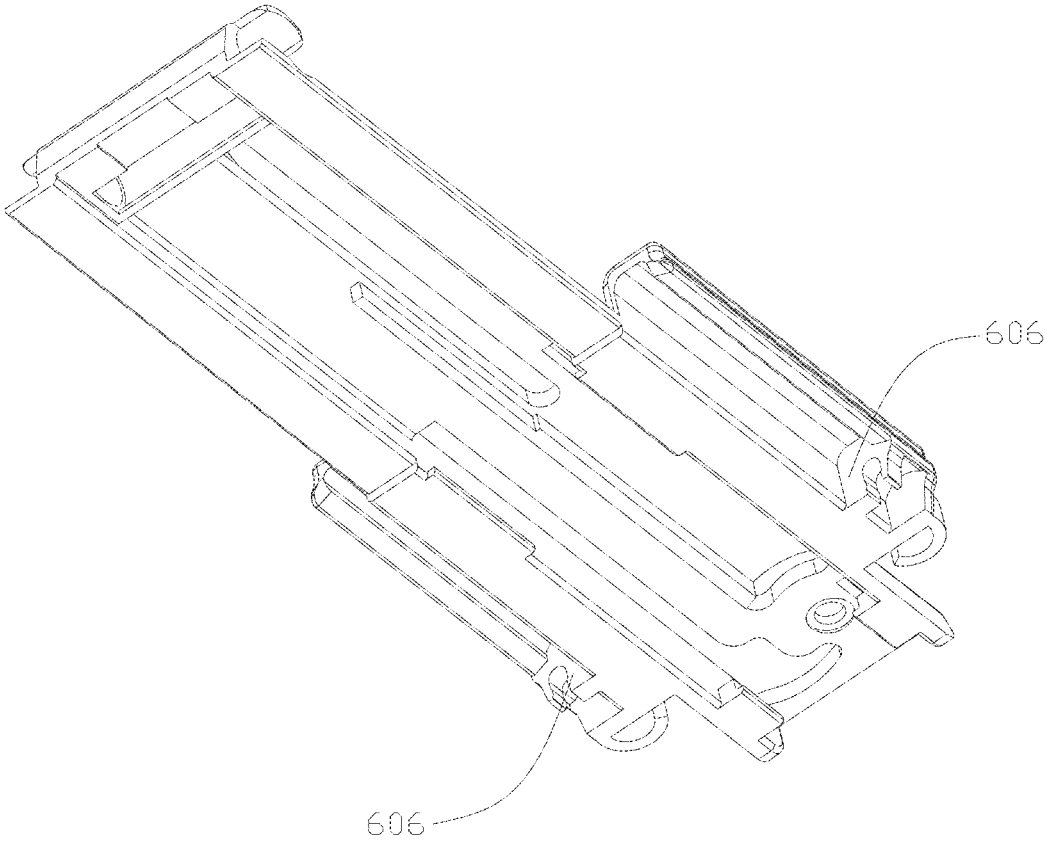
FIG. 7 is a schematic structural diagram of another view of the sliding bracket in the damping and rebounding sliding rail of the present disclosure.

The meanings of the reference numerals are as follows:

1 outer rail; 2 inner rail; 3 middle rail; 4 first snap block; 401 first positioning block; 402 first mounting hole; 403 first guide groove; 4031 first guide segment; 4032 second guide segment; 404 first protruding block; 405 second guide groove; 4051 first oriented surface; 4052 second oriented surface; 4053 first snap groove; 4054 second snap groove; 406 second protruding block; 4061 notch; 407 third guide groove; 4071 third oriented surface; 4072 third snap groove; 408 third protruding block; 4081 fourth oriented surface; 409 oriented block; 5 second snap block; 501 second positioning block; 502 second mounting hole; 503 contact surface; 504 abutment surface; 6 sliding bracket; 601 arc-shaped hole; 602 third mounting hole; 603 first escape groove; 604 second escape groove; 605 mounting bracket; 606 first buckle; 7 fixing bracket; 701 first chute; 7011 straight groove segment; 7012 first bent segment; 7013 second bent segment; 7014 first guide surface; 7015 second guide surface; 702 positioning post; 703 second chute; 7031 third buckle; 704 limit rail; 705 second buckle; 8 damping member; 9 tension member; 10 first limit member; 11 second limit member; 12 slider; 13 elastic member; 14 rivet.

DETAILED DESCRIPTION

For a better understanding and implementation, the technical solutions in the embodiments of the present disclosure are clearly and completely described below in conjunction with the attached drawings of the present disclosure.

In the description of the present disclosure, it is to be noted that the terms "up", "down", "front", "back", "left", "right", "vertical", "horizontal", "top", "bottom", "inside", "outside" and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure.

Unless otherwise defined, all terms including technical and scientific terms used herein have the same meaning as commonly understood by those skilled in the art to which the present disclosure belongs. The terms used herein in the specification of the present disclosure are used only to describe specific embodiments and are not intended as a limitation of the disclosure.

Referring to FIGS. 1 to 27, provided in the present disclosure is a damping and rebounding sliding rail, including an outer rail 1, an inner rail 2 slidably disposed in the outer rail 1, a damping device arranged at an end of the outer rail 1, and a rebound device arranged between the damping device and the inner rail 2. When the inner rail 2 is pushed to slide relative to the outer rail 1 until the inner rail 2 is close to the damping device, the inner rail 2, under the action of the damping device, is capable of being driven to slide with damping and synchronously compressing the rebound device so as to allow the rebound device to storage energy, then the inner rail 2 is pushed again in the same direction, and the rebound device releases elastic force and drives the inner rail 2 to slide in an opposite direction to achieve pop-up.

In this embodiment, in order to increase the sliding stroke of the inner rail 2, a middle rail 3 is further provided between the outer rail 1 and the inner rail 2. Of course, in other embodiments, in order to achieve a larger sliding stroke, a plurality of middle rails 3 may be provided, which are not limited herein.

In such an arrangement, the damping and rebounding sliding rail of the present disclosure not only realizes the function of damping closure and pressing rebound, but also synchronously compresses the rebound device for energy storage during the damping closure of the inner rail. When the inner rail needs to be opened, it can be bounced open by simply pressing the inner rail again. The entire operation process is simple and convenient, saving time and labor.

Referring to FIGS. 1 to 9, the damping device includes a fixing bracket 7 fixedly arranged at an end of the outer rail 1, a sliding bracket 6 slidably arranged in the outer rail 1 and slidable in a direction proximal to or distal to the fixing bracket 7, a damping member 8 arranged on the sliding bracket 6, and a tension member 9 arranged between the fixing bracket 7 and the sliding bracket 6 and configured to pull the sliding bracket 6 to slide in the direction proximal to the fixing bracket 7. Specifically, the damping member 8 is a telescopic cylinder, and a mounting bracket 605 configured to mount the telescopic cylinder in the form of a sleeve is provided at an end of the sliding bracket 6 proximal to the fixing bracket 7. Two sides of the fixing bracket 7 are respectively provided with a tapered limit rail 704 and the side walls of the limit rail 704 are inclined from a direction distal to the fixing bracket 7 to a direction proximal to the fixing bracket 7. A telescopic end of the telescopic cylinder is abutted against and cooperated with the side walls of the limit rail 704. Thus, when the sliding bracket 6 is pulled under the action of the tension member 9 and slides in a direction proximal to the fixing bracket 7, since the width of the limit rail 704 is gradually reduced, the telescopic end of the telescopic cylinder can be compressed, so that the pressure can be converted into resistance when the tension member 9 is retracted, thereby achieving the damping sliding of the sliding bracket 6.

In this embodiment, the tension members 9 are two springs spaced apart. The bottom of the sliding bracket 6 is provided with a first buckle 606, the bottom of the fixing bracket 7 is provided with a second buckle 705, an end of the spring is attached to the first buckle 606, and an opposite end thereof is attached to the second buckle 705, the damping member 8 is a cylinder, and two telescopic ends of the cylinder are abutted against the side walls of two limit rails 704, respectively.

Further, the sliding bracket 6 is rotatably connected with a first limit member 10. The fixing bracket 7 is provided with a first chute 701 for insertion of the first limit member 10, and the first chute 701 includes a straight groove segment 7011 and a first bent segment 7012 communicating with an end of the straight groove segment 7011. Specifically, the first limit member 10 includes a first limit block and a first limit post disposed on the first limit block, the sliding bracket 6 is provided with an arc-shaped hole 601 configured to be passed through by the first limit post passes and to restrict the swing of the first limit post, and the lower end of the first limit post is inserted in the first chute 701.

Thus, the first limit post is in a locked state when the first limit post is located at the first bent segment 7012, so that the sliding bracket 6 is also in a locked state, the sliding bracket 6 is located on a side distal to the fixing frame 7, and the tension member 9 is stretched; when the first limit post is driven to be disengaged from the first bent segment 7012 and enter the straight groove segment 7011, the sliding bracket 6 is unlocked and is, under the action of the tension member 9, driven to slide along the straight groove segment 7011 and gradually approach the fixing bracket 7.

In this embodiment, the sliding bracket 6 is provided with a third mounting hole 602 configured to mount the first limit member 10. Thus, the first limit member 10 can be fixed to the sliding bracket 6 by passing a rivet 14 through the third mounting hole 602 and the first limit block.

Further, an end of the inner rail 2 proximal to the damping device is further provided with a first snap block 4, the first snap block 4 is provided with a first guide groove 403 configured to guide the sliding of the first limit member 10, and the first guide groove 403 is provided with a first protruding block 404 that can be abutted against and cooperated with the first limit member 10. The first guide groove 403 includes a first guide segment 4031 extended horizontally and a second guide segment 4032 connected with the first guide segment 4031 and bent in shape. Thus, when the inner rail 2 is pushed to slide until being close to the damping device, the first limit member 10 slides into the first guide groove 403 and slides along the first guide segment 4031 until it slides into the second guide segment 4032, the first limit member 10, under the guidance of the second guide segment 4032, is disengaged from the first bent segment 7012 and enters the straight groove segment 7011, and then under the action of the tension member 9, the first limit member 10 is abutted against the first protruding block 404 and drives the first protruding block 404 to slide along the straight groove segment 7011.

In this embodiment, the first snap block 4 is provided with a first positioning block 401 and a first mounting hole 402, and the inner rail 2 is provided with a positioning groove cooperated with the first positioning block 401 and a positioning hole cooperated with the first mounting hole 402. Thus, it is achieved that the first snap block 4 is fixed to the inner rail 2 when the first positioning block 401 is snapped into the positioning groove and is fixed by passing the rivet 14 through the first mounting hole 402 and the positioning hole.

Referring to FIGS. 1 to 9, the rebound device includes a slider 12 slidably provided on the fixing bracket 7 and an elastic member 13 connected with the slider 12, the slider 12 penetrates out of the sliding bracket 6, and a second snap block 5 abutted against and cooperated with the slider 12 is provided at an end of the inner rail proximal to the damping device. Specifically, the fixing bracket 7 is provided with a second chute 703 for sliding of the slider 12, and a third buckle 7031 is provided on the second chute 703; the elastic member 13 is a spring and is located in the second chute 703, an end of the spring is attached to the third buckle 7031, and an opposite end thereof is connected to the slider 12. Thus, under the action of the tension member 9, the first limit member 10 drives the inner rail 2 to slide with damping, while the second snap block 5 can be abutted against the slider 12 and drive the slider 12 to slide to stretch the elastic member 13, thereby realizing the energy storage of the rebound device.

In this embodiment, the tensile force of the tension member 9 is greater than the elastic force of the elastic member 13; the second snap block 5 is provided with a second positioning block 501 and a second mounting hole 502, and the inner rail 2 is also provided with a positioning groove cooperated with the second positioning block 501 and a positioning hole cooperated with the second mounting hole 502. Thus, it is achieved that the second snap block 5 is fixed to the inner rail 2 when the second positioning block 501 is snapped into the positioning groove and is fixed by passing the rivet 14 through the second mounting hole 502 and the positioning hole. The sliding bracket 6 is provided with a second escape groove 604 through which the slider 12 passes. A front end of the second snap block 5 is provided with an abutment surface 503 configured to be abutted against and cooperated with the slider 12.

Figure 8:
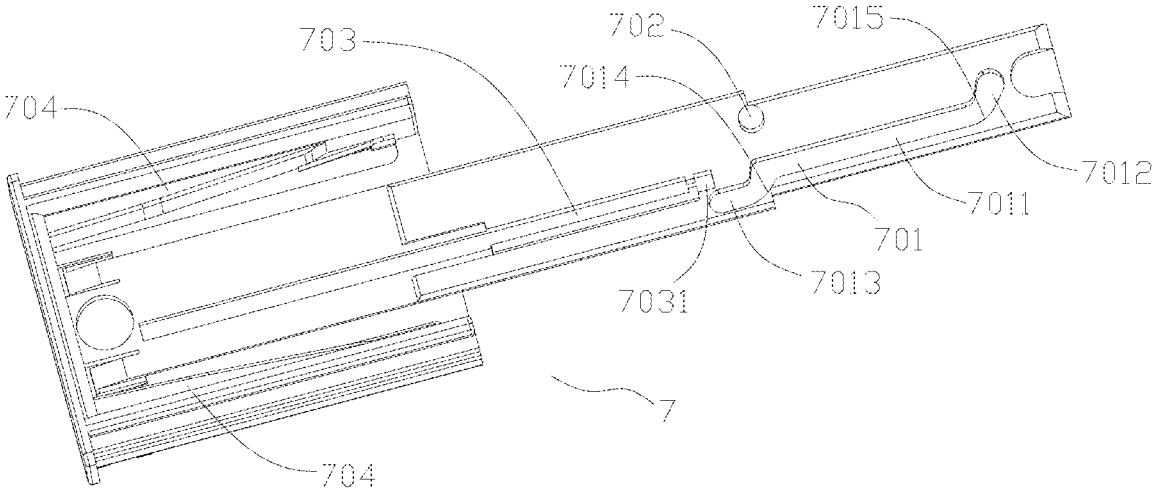
FIG. 8 is a schematic structural diagram of the fixing bracket in the damping and rebounding sliding rail of the present disclosure.
Figure 9:
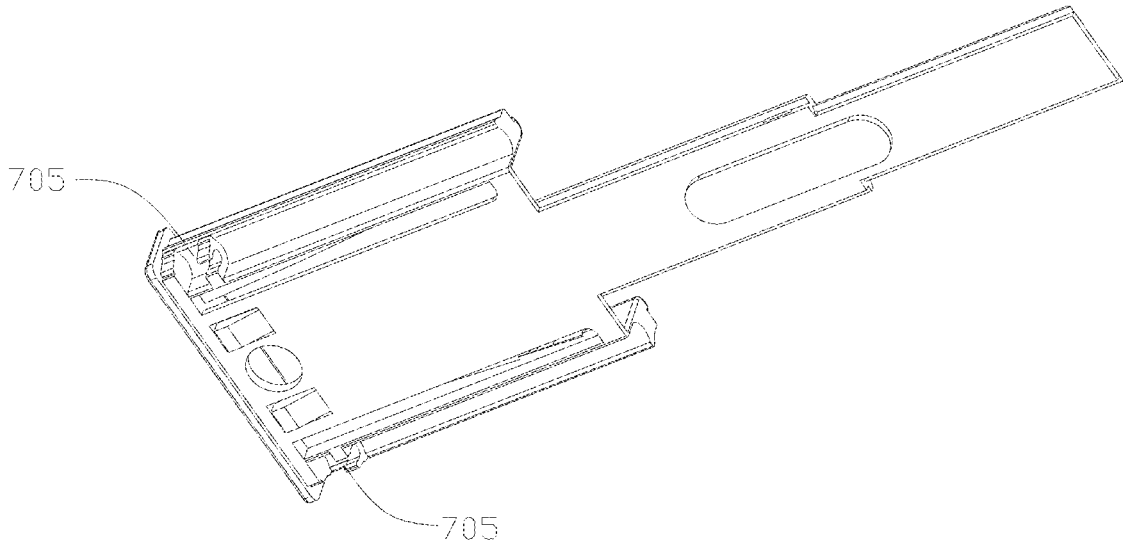
FIG. 9 is a schematic structural diagram of another view of the fixing bracket in the damping and rebounding sliding rail of the present disclosure.

Referring to FIG. 8, the first chute 701 further includes a second bent segment 7013 communicating with an opposite end of the straight groove segment 7011, and a bending direction of the second bent segment 7013 is opposite to a bending direction of the first bent segment 7012. Thus, when the inner rail 2 is pushed again in the direction proximal to the fixing bracket 7, under the guidance of the second guide segment 4032, the first limit member 10 continues to slide and disengages from the straight groove segment 7011 until it enters the second bent segment 7013, at which time the first limit member 10 is separated from the first protruding block 404, and under the action of the elastic member 13, the slider 12 abutted against the second clamp block 5 slides in a direction distal to the fixing bracket 7 to achieve pop-up.

In addition, an abutment surface 504 configured to be abutted against the first limit member 10 is provided at an end of the second snap block 5 distal to the fixing bracket 7, the abutment surface 504 including a vertical surface and an inclined surface connecting the vertical surface; a first guide surface 7014 configured to guide the first limit member 10 from the second bent segment 7013 entering the straight groove segment 7011 is provided between the second bent segment 7013 and the straight groove segment 7011; and a second guide surface 7015 configure to guide the first limit member 10 from the straight groove segment 7011 entering the first bent segment 7012 is provided between the straight groove segment 7011 and the first bent segment 7012.

Thus, when the inner rail 2 is fully pulled out, the abutment surface 504 of the second snap block 5 is abutted against and drives the first limit member 10 to slide, thereby driving the sliding bracket 6 to slide in a direction distal to the fixing bracket 7 and synchronously stretching the tension member 9. Under the guidance of the first guide surface 7014, the first limit member 10 can slide from the second bent segment 7013 to the straight groove segment 7011, and then slid along the straight groove segment 7011 and, under the guidance of the second guide surface 7015, into the first bent segment 7012, at which time the sliding bracket 6 is locked again and the stretching of the tension member 9 is synchronously completed to achieve energy storage of the damping device. The second snap block 5 is separated from the first limit member 10, and then the inner rail 2 can be further pulled outward.

In this embodiment, the first guide surface 7014 is a first guide slope or a first guide arc surface; the second guide surface 7015 is a second guide slope or a second guide arc surface.

Referring to FIGS. 1 to 9, the rebound device further includes a second limit member 11 rotatably connected to the fixing bracket 7, the second limit member 11 includes a second limit block and a second limit post protruding on the second limit block, the fixing bracket 7 is protruded with a positioning post 702, and the second limit block is provided with a positioning hole that can be sleeved on the positioning post 702, thereby realizing rotatable connection to the fixing bracket 7. The first snap block 4 is further provided with a second guide groove 405, the second guide groove 405 is provided with a first oriented surface 4051, a second snap groove 4054, a second oriented surface 4052, and a first snap groove 4053, the second guide groove 405 is further provided with a second protruding block 406, and the second protruding block 406 is provided with a notch 4061 snap-fitted with the second limit post of the second limit member 11.

In addition, the first snap block 4 is further provided with a third guide groove 407, the third guide groove is provided with a third oriented surface 4071 and a third snap groove 4072, a third protruding block 408 is further provided in the third guide groove 407, the third protruding block 408 is provided with a fourth oriented surface 4081 configured to guide the second limit member 11 from the third guide groove 407 into the second guide groove 405.

In this embodiment, the first oriented surface 4051, the second oriented surface 4052, the third oriented surface 4071, and the fourth oriented surface 4081 are all guide slopes. Of course, in other embodiments, they can also be guide arc surfaces, which are not limited herein. The sliding bracket 6 is provided with a first escape groove 603 through which the second limit member 11 penetrates out.

Thus, when the inner rail 2 is pushed to slide until being close to the damping device, the second limit member 11 first slides into the third guide groove 407 and enters the third snap groove 4072 along the third oriented surface 4071; and subsequently, when the inner rail 2 is pressed and popped out, the second limit member 11 slides into the second guide groove 405 from the third guide groove 407 under the guidance of the fourth oriented surface 4081 of the third protruding block 408. If the inner rail 2 is pressed again instead of being pulled out in this case, the second limit member 11 may slide along the second guide groove 405 and enter the second snap groove 4054 along the first oriented surface 4051, then the inner rail 2 released, and the second limit post on the second limit member 11 is engaged with the notch 4061 on the second protruding block 406, thereby locking the inner rail 2. Then, the inner rail 2 is pressed again in the same direction, and the second limit member 11 slides along the second oriented surface 4052, is disengaged from the notch 4061, and enters the first snap groove 4053. Then, the inner rail 2 is released, and the second limit member 11 can slide out along the second guide groove 405. This section works on the same principle as the rebound devices available on the market.

Figure 10:
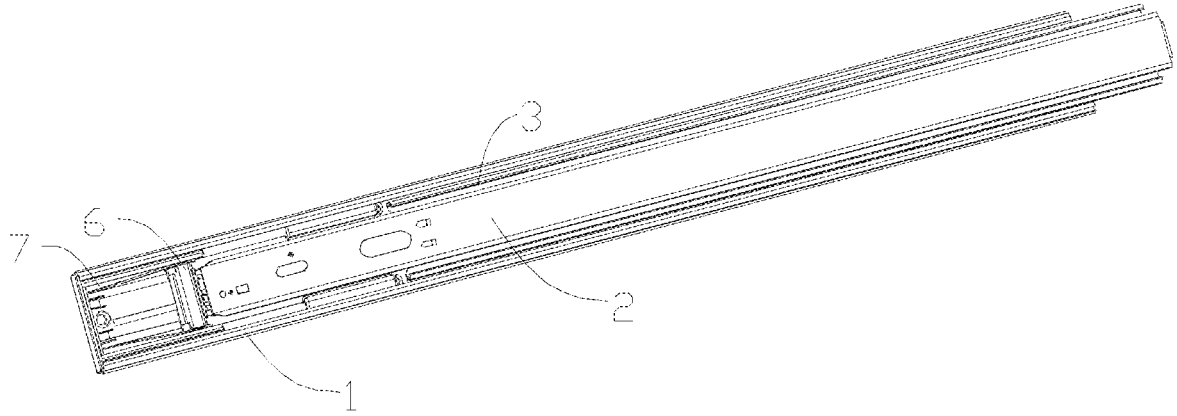
FIG. 10 is a schematic state diagram of the damping and rebounding sliding rail of the present disclosure when the inner rail starts to buffer and close.
Figure 11:
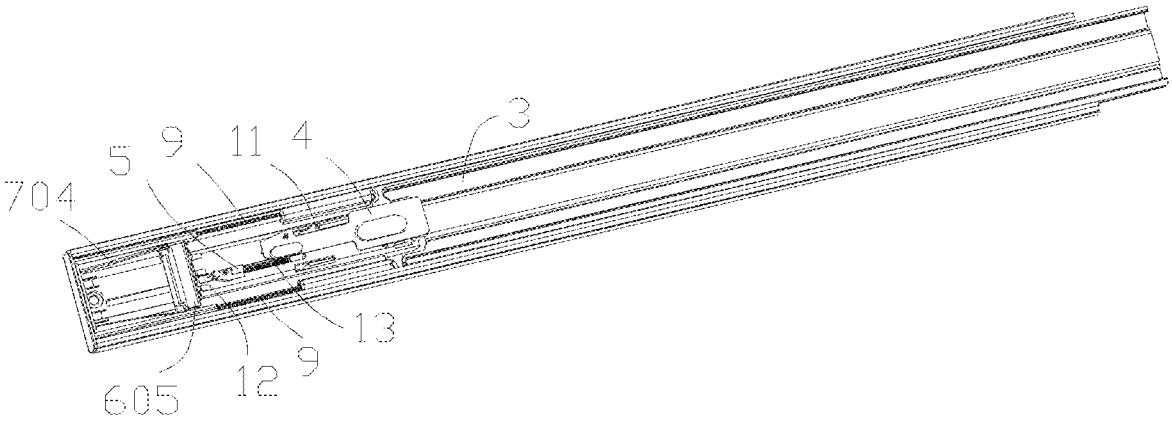
FIG. 11 is a schematic structural diagram of FIG. 10 with the inner rail removed.
Figure 12:
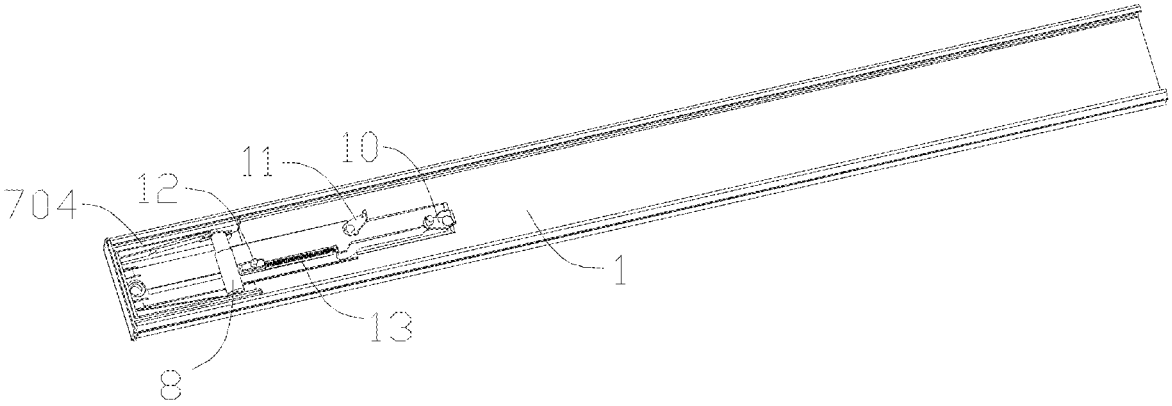
FIG. 12 is a schematic diagram of a partial structure in FIG. 11.
Figure 13:
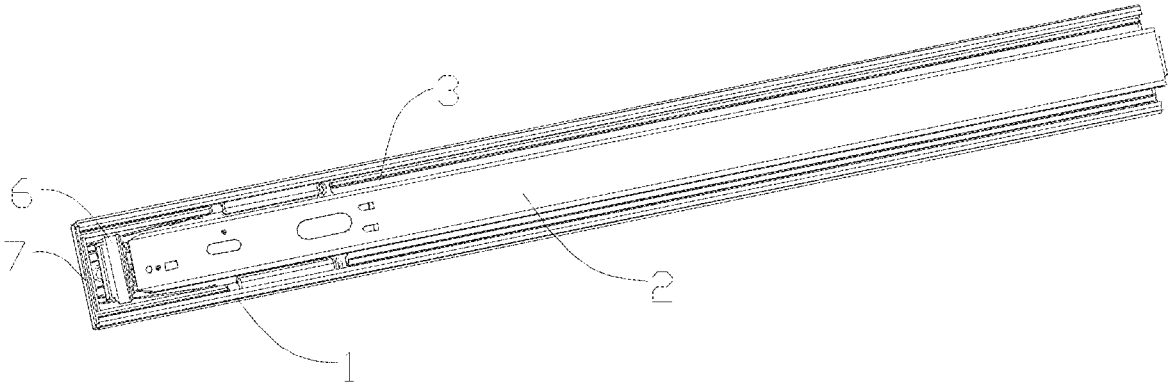
FIG. 13 is a schematic state diagram of the damping and rebounding sliding rail of the present disclosure after the buffer closure of the inner rail is completed.
Figure 14:
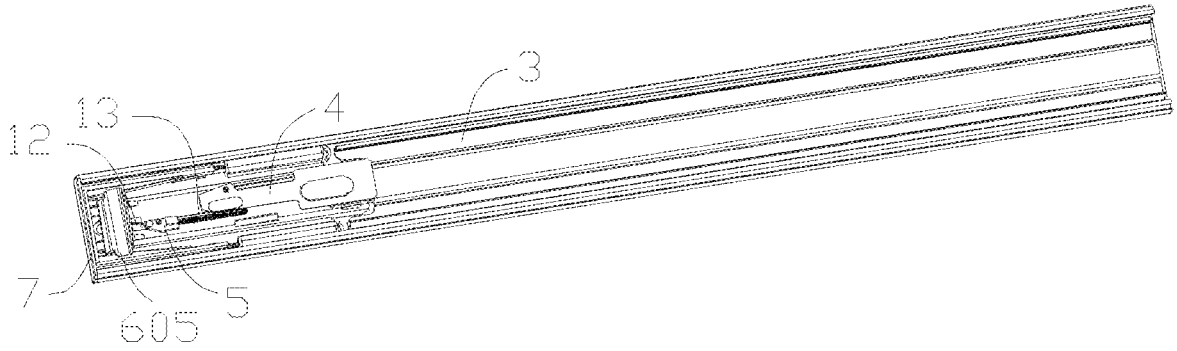
FIG. 14 is a schematic structural diagram of FIG. 13 with the inner rail removed.
Figure 15:
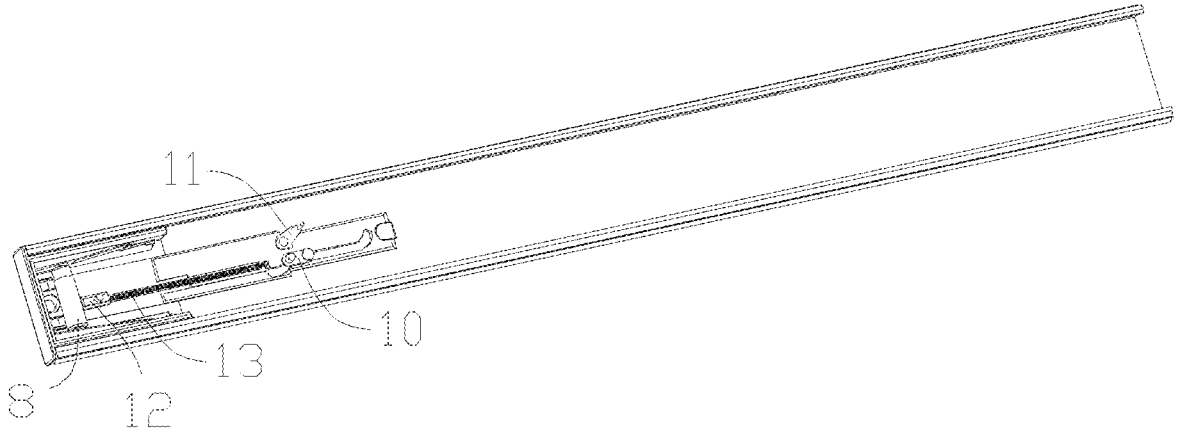
FIG. 15 is a schematic diagram of a partial structure in FIG. 14.
Figure 16:
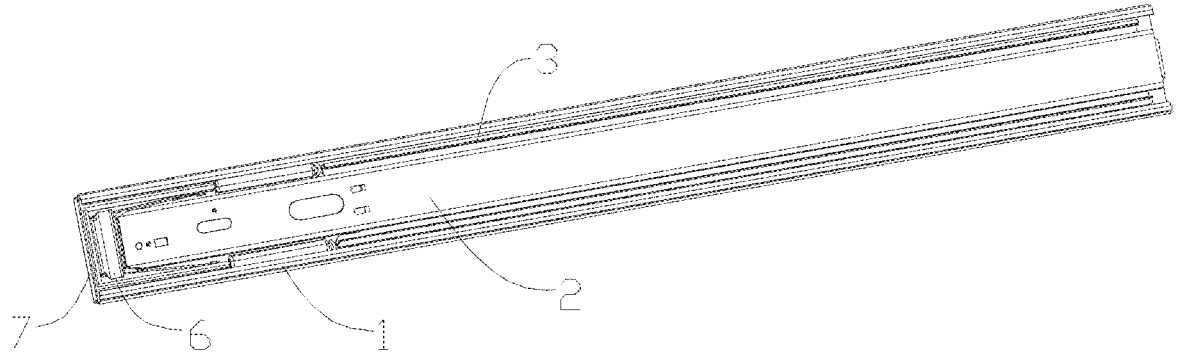
FIG. 16 is a schematic state diagram of the damping and rebounding sliding rail of the present disclosure when the inner rail closes to the end.
Figure 17:
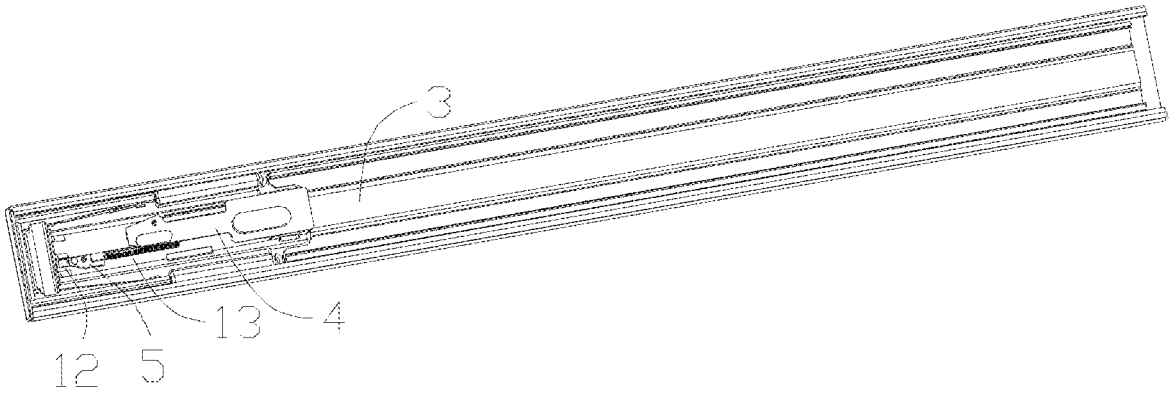
FIG. 17 is a schematic structural diagram of FIG. 16 with the inner rail removed.
Figure 18:
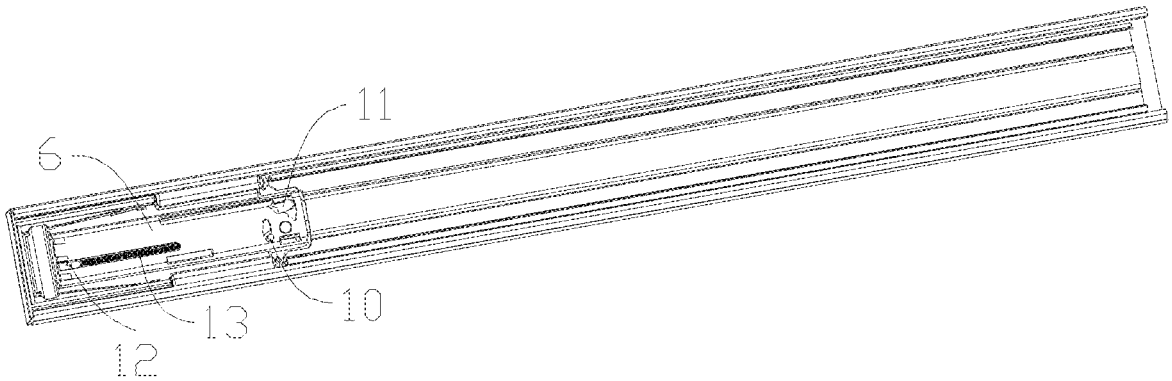
FIG. 18 is a schematic structural diagram of FIG. 17 with the first snap block and the second block removed.
Figure 19:
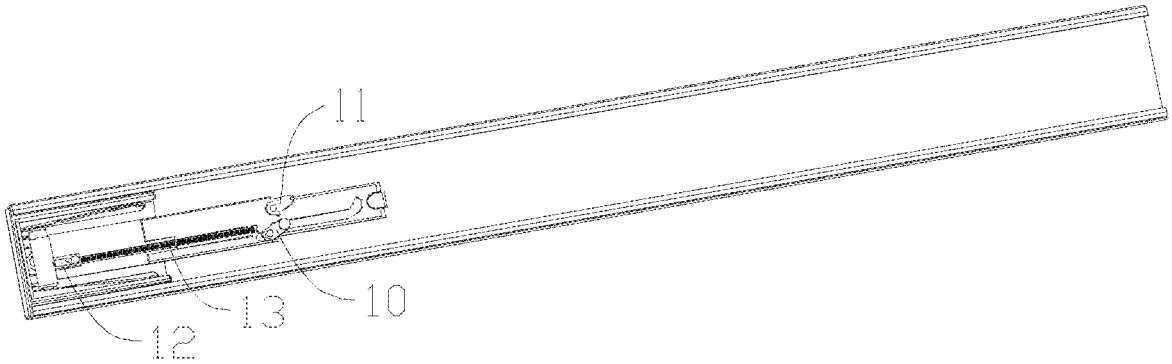
FIG. 19 is a schematic diagram of a partial structure in FIG. 18.
Figure 20:
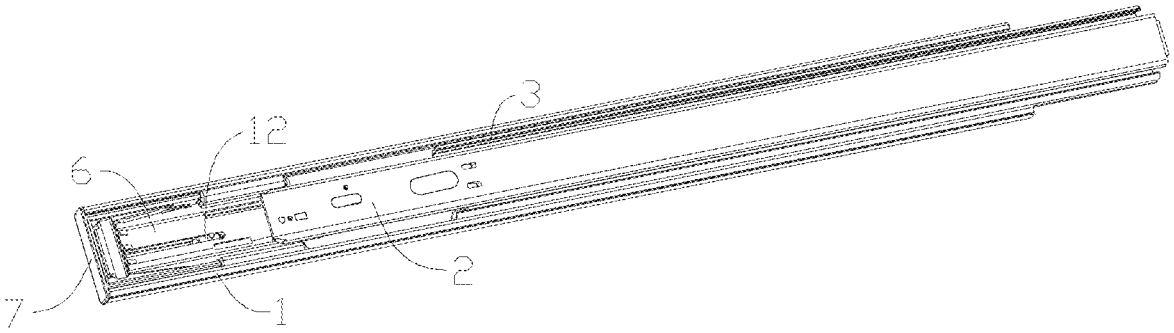
FIG. 20 is a schematic state diagram of the damping and rebounding sliding rail of the present disclosure after the inner rail bounces and slides out.
Figure 21:
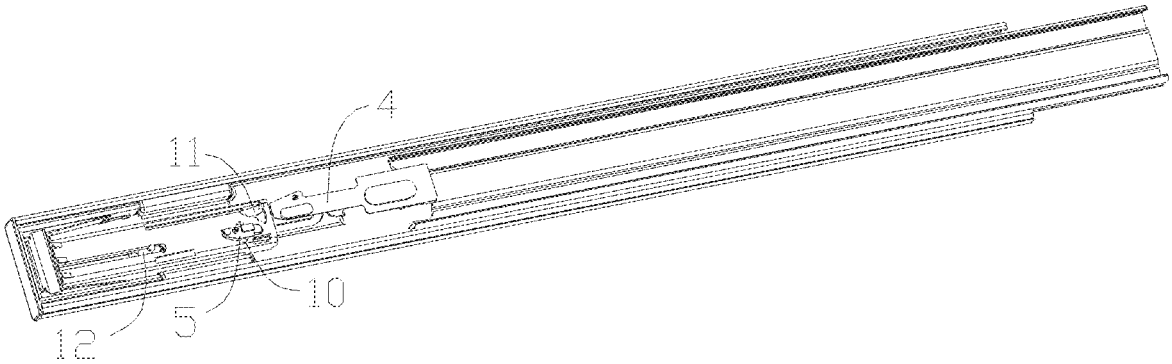
FIG. 21 is a schematic structural diagram of FIG. 20 with the inner rail removed.
Figure 22:
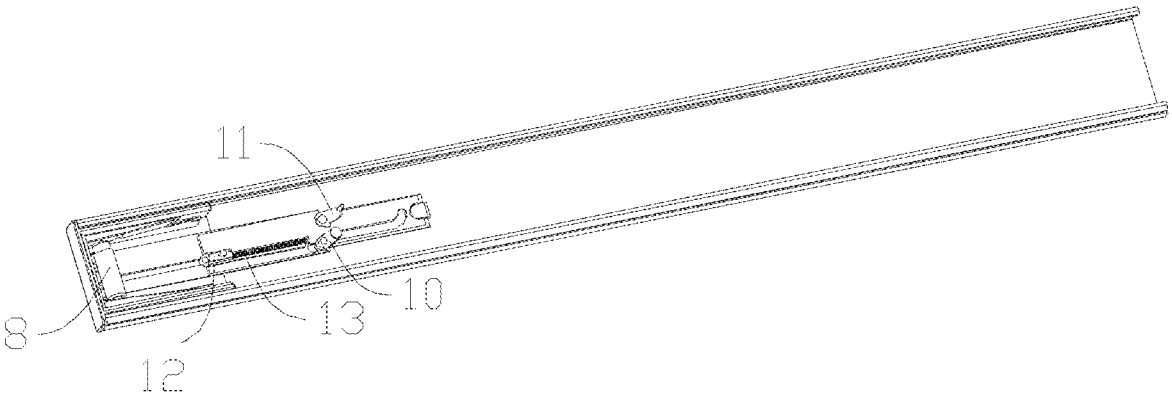
FIG. 22 is a schematic diagram of a partial structure in FIG. 21.
Figure 23:
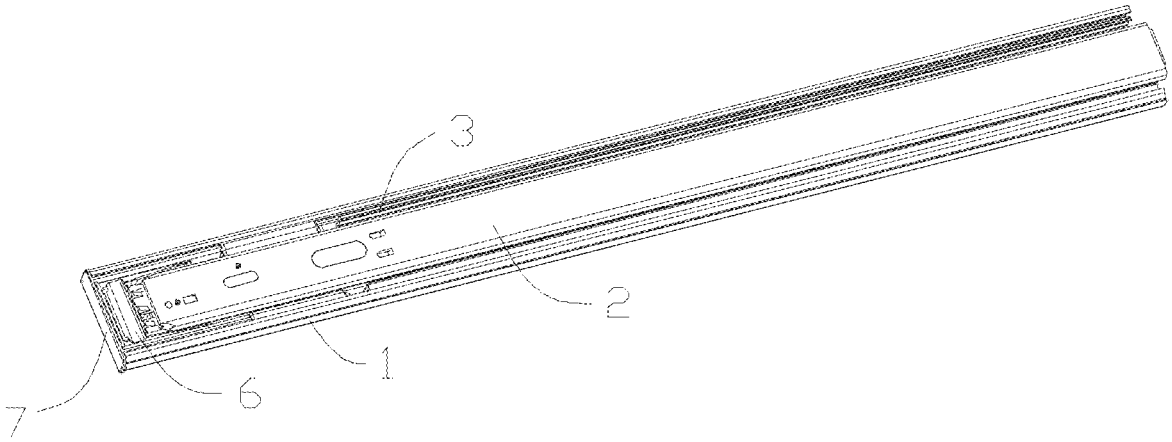
FIG. 23 is a schematic state diagram of the damping and rebounding sliding rail of the present disclosure when the inner rail is locked.
Figure 24:
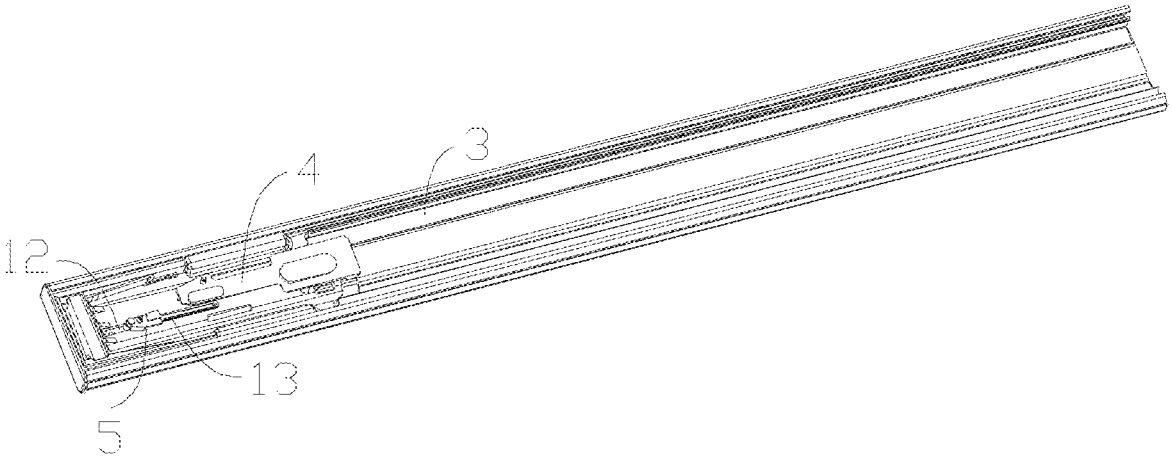
FIG. 24 is a schematic structural diagram of FIG. 23 with the inner rail removed.
Figure 25:
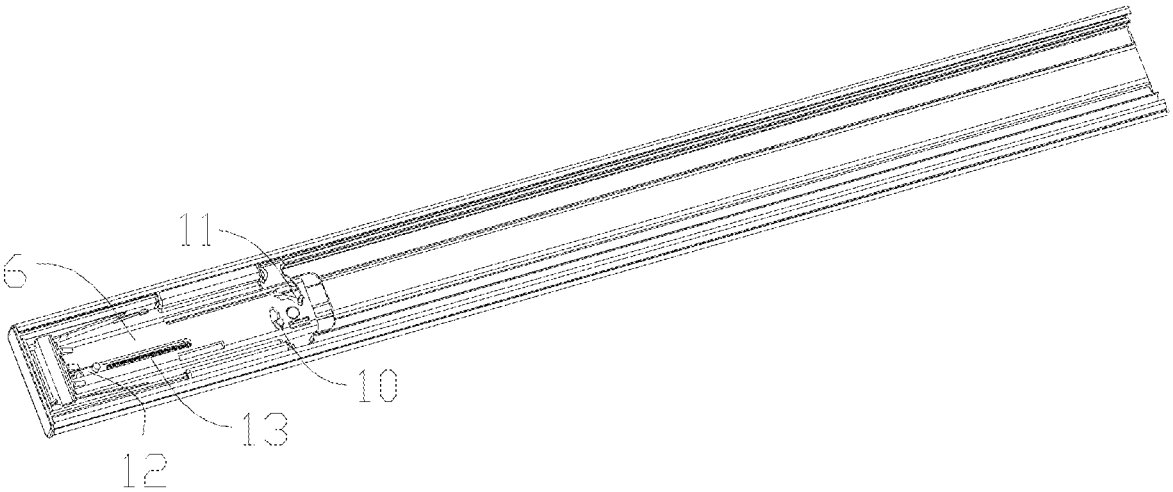
FIG. 25 is a schematic structural diagram of FIG. 24 with the first snap block and the second block removed.
Figure 26:
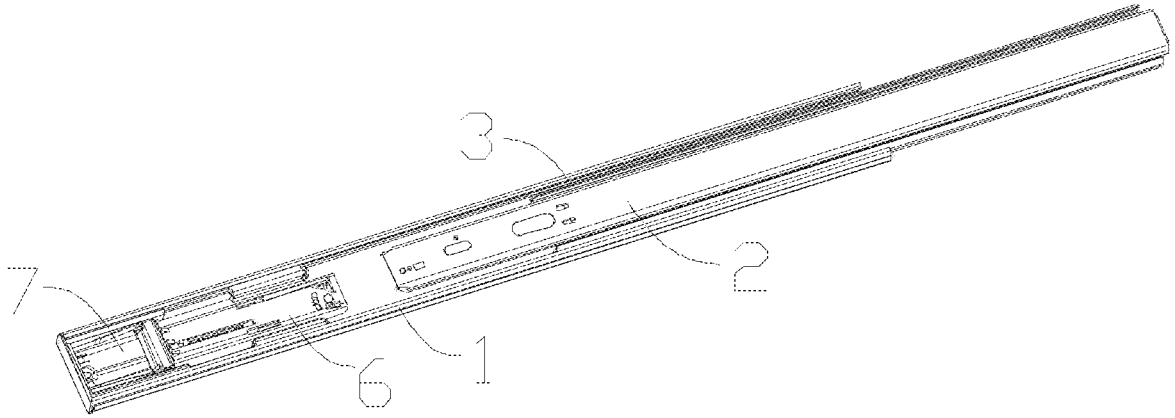
FIG. 26 is a schematic state diagram of the damping and rebounding sliding rail of the present disclosure when the inner rail completely slides out.
Figure 27:
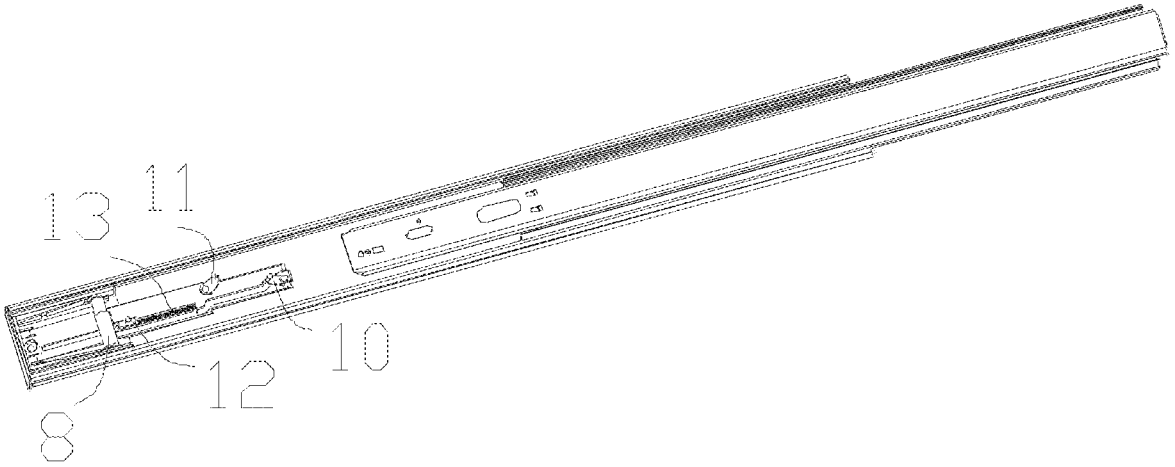
FIG. 27 is a schematic structural diagram of FIG. 26 with the sliding bracket removed.

Thus, the action process of the damping and rebounding sliding rail of the present disclosure is as follows:

Referring to FIGS. 26 to 27, the inner rail 2 is in a pulled-out state and away from the damping device, the sliding bracket 6 is far away from the fixing bracket 7 and the first limit member 10 is located at the first bent segment 7012, at which time the sliding bracket 6 is in a locked state and the tension member 9 is in a tension state. The inner rail 2 is then pushed by hand to start to slide and close, and the inner rail 2 slides in a direction close to the damping device until it approaches the sliding bracket 6 of the damping device. As shown in FIGS. 10 to 12, the first limit member 10 swings along the arc-shaped hole 601 under the guidance of the first guide groove 403 to be gradually disengaged from the first bent segment 7012 until it enters the straight groove segment 7011. At this time, the sliding bracket 6 is unlocked, under the action of the tension member 9, the first limit member 10 is abutted against the first protruding block 404 and drives the first protruding block 404 and the inner rail 2 to slide and close, and the buffer closure is achieved under the action of the damping member 8, while the second snap block 5 on the inner rail 2 is synchronously abutted against the slider 12 and drives the slider 12 to slide along the second chute 703 to stretch the elastic member 13, while the second limit member 11 on the fixing bracket 7 slides along the third guide groove 407 until the buffer closure is completed. As shown in FIGS. 13 to 15, at this time, the first limit member 10 is located at the other end of the straight groove segment 7011 proximal to the second bent segment 7013, and the second limit member 11 is located at the third snap groove 4072 proximal to the third guide groove 407. Subsequently, when the inner rail 2 is pressed again and closed to the end, under the guiding action of the second guide segment 4032, the first limit member 10 continues to slide along the arc-shaped hole 601 to be gradually disengaged from the straight groove segment 7011 until entering the second bent segment 7013, at which time the first limit member 10 is separated from the first protruding block 404, and the second limit member 11 is located in the third snap groove 4072, as shown in FIGS. 16 to 19. Subsequently, under the action of the elastic member 13, the slider 12 is abutted against the second snap block 5 and slides in a direction distal to the fixing bracket 7 to achieve the pop-up of the inner rail 2, while the second limit member 11 slides along the fourth oriented surface 4081 of the third protruding block 408 and slides from the third guide groove 407 into the second guide groove 405 until it is completely popped out, as shown in FIGS. 20 to 22, at which time the second snap block 5 on the inner rail 2 is abutted against the first limit member 10. If the inner rail 2 is not further pulled out and the inner rail 2 is pressed again in this case, the second limit member 11 can slide along the second guide groove 405 and enter the second snap groove 4054 along the first oriented surface 4051. Then, the inner rail 2 is released, and the second limit member 11 is snap-fitted with the notch 4061 on the second protruding block 406 to achieve the locking of the inner rail 2, as shown in FIGS. 23 to 25. Then, the inner rail 2 is pressed again, and the second limit member 11 can slide along the second oriented surface 4052 and be disengaged from the notch 4061 to achieve the unlocking of the inner rail 2. As shown in FIGS. 26 to 27, if the inner rail 2 is further pulled out in this case, the second snap block 5 is abutted against the first limit member 10 and drives it to slide, thereby driving the sliding bracket 6 to slide in a direction distal to the fixing bracket 7 and synchronously stretching the tension member 9. Under the guidance of the first guide surface 7014, The first limit member 10 slides from the second bent segment 7013 into the straight groove segment 7011, then slides along the straight groove segment 7011 and, under the guidance of the second guide surface 7015, enters the first bent segment 7012. At this time, the sliding bracket 6 is locked again and synchronously completes the stretching of the tension member 9, as shown in FIGS. 26 to 27. At this time, the second snap block 5 and the first limit member 10 are in a separate state, and then the inner rail 2 can be further pulled out. At the same time, the second limit member 11 exits the second guide groove 405 and exits the second guide groove 405 under the guidance of the oriented block 409.

In addition, provided in the present disclosure is further a drawer assembly, including a drawer and a damping and rebounding sliding rail arranged on the left and right sides of the drawer.

In summary, disclosed in the present disclosure is a damping and rebounding sliding rail and a drawer assembly including the same, the damping and rebounding sliding rail not only realizes the function of damping closure and pressing rebound, but also synchronously compresses the rebound device for energy storage during the process of damping closure of the inner rail 2. When the inner rail 2 needs to be opened, it can be bounced open by simply pressing the inner rail 2 again. The entire operation process is simple and convenient, saving time and labor.

It should be noted that when one element is referred to as "fixed to" or "provided on" another element, it can be directly on the other element or indirectly on the other element. When one element is referred to be "connected" to another element, it may be directly connected to the other element or indirectly connected to the other element.

It is to be understood that the terms "top", "bottom", "inside", "outside", and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure.

Moreover, in the description of the present disclosure, the meaning of "a plurality of" and "a number of" is two or more, unless specifically and specifically defined otherwise.

The technical means disclosed in the solution of the present disclosure are not limited to those disclosed in the embodiments mentioned above but also include technical solutions consisting of any combination of the above technical features. It should be noted that for those skilled in the art, a plurality of improvements and modifications may be made without departing from the principles of the present disclosure. These improvements and modifications are also considered to be within the scope of protection of the present disclosure.

The invention claimed is:

1. A damping and rebounding sliding rail, comprising:

an outer rail;

an inner rail, slidably disposed within the outer rail;

a damping device, disposed at an end of the outer rail; and a rebound device, wherein the damping device comprises:

a fixing bracket, fixedly disposed at an end of the outer rail;

a sliding bracket, slidably disposed within the outer rail and slidable in a direction proximal to or distal to the fixing bracket;

a damping member, disposed on the fixing bracket or the sliding bracket; and a tension member, disposed between the fixing bracket and the sliding bracket, configured to pull the sliding bracket to slide in the direction proximal to the fixing bracket;

the sliding bracket is rotatably connected with a first limit member, and the fixing bracket is provided with a first chute for insertion of the first limit member, the first chute comprising a straight groove segment and a first bent segment communicating with an end of the straight groove segment;

wherein, when the inner rail is pushed to slide relative to the outer rail until the inner rail is close to the damping device, the inner rail is capable of being driven to slide with damping and synchronously compressing the rebound device under the action of the damping device, then the inner rail is pushed again in the same direction, and the rebound device releases elastic force and drives the inner rail to slide in an opposite direction to achieve pop-up.

2. The damping and rebounding sliding rail according to claim 1, wherein a first snap block is provided at an end of the inner rail proximal to the damping device, a first guide groove configured to guide the first limit member out of the first bent segment and into the straight groove segment is provided on the first snap block, and a first protruding block abutted against the first limit member is provided in the first guide groove.

3. The damping and rebounding sliding rail according to claim 2, wherein the first guide groove comprises a first guide segment extended horizontally and a second guide segment connected with the first guide segment and bent in shape.

4. The damping and rebounding sliding rail according to claim 2, wherein the rebound device comprises a slider slidably provided on the fixing bracket and an elastic member connected with the slider, the slider penetrates out of the sliding bracket, and a second snap block abutted against and cooperated with the slider is provided at an end of the inner rail proximal to the damping device.

5. The damping and rebounding sliding rail according to claim 4, wherein the first chute further comprises a second bent segment in communication with an opposite end of the straight groove segment, and a bending direction of the second bent segment is opposite to a bending direction of the first bent segment.

6. The damping and rebounding sliding rail according to claim 5, wherein an abutment surface configured to be abutted against the first limit member is provided at an end of the second snap block distal to the fixing bracket; a first guide surface configured to guide the first limit member from the second bent segment entering the straight groove segment is disposed between the second bent segment and the straight groove segment; and a second guide surface configured to guide the first limit member from the straight groove segment entering the first bent segment is disposed between the straight groove segment and the first bent segment.

7. The damping and rebounding sliding rail according to claim 2, wherein the rebound device further comprises a second limit member rotatably connected to the fixing bracket and extending out of the sliding bracket, a second guide groove provided on the first snap block, and a second protruding block provided on the second guide groove, and the second protruding block is provided with a notch snap-fitted with the second limit member.

8. The damping and rebounding sliding rail according to claim 7, wherein the first snap block is further provided with a third guide groove and a third protruding block disposed in the third guide groove, and the third protruding block is configured to guide the second limit member from the third guide groove entering the second guide groove.

9. The damping and rebounding sliding rail according to claim 1, wherein the damping member is a telescopic cylinder provided on the sliding bracket, the fixing bracket is provided with at least one limit rail and a side wall of the limit rail is inclined from a direction distal to the fixing bracket to a direction proximal to the fixing bracket, and a telescopic end of the telescopic cylinder is abutted against and cooperated with the side wall of the limit rail.

10. A drawer assembly, comprising a drawer and a damping and rebounding sliding rail arranged on left and right sides of the drawer, wherein the damping and rebounding sliding rail comprises:

an outer rail;

an inner rail, slidably disposed within the outer rail;

a damping device, disposed at an end of the outer rail; and a rebound device, wherein the damping device comprises:

a fixing bracket, fixedly disposed at an end of the outer rail;

a sliding bracket, slidably disposed within the outer rail and slidable in a direction proximal to or distal to the fixing bracket;

a damping member, disposed on the fixing bracket or the sliding bracket; and a tension member, disposed between the fixing bracket and the sliding bracket, configured to pull the sliding bracket to slide in the direction proximal to the fixing bracket;

the sliding bracket is rotatably connected with a first limit member, and the fixing bracket is provided with a first chute for insertion of the first limit member, the first chute comprising a straight groove segment and a first bent segment communicating with an end of the straight groove segment;

wherein, when the inner rail is pushed to slide relative to the outer rail until the inner rail is close to the damping device, the inner rail is capable of being driven to slide with damping and synchronously compressing the rebound device under the action of the damping device, then the inner rail is pushed again in the same direction, and the rebound device releases elastic force and drives the inner rail to slide in an opposite direction to achieve pop-up.

11. The drawer assembly according to claim 10, wherein a first snap block is provided at an end of the inner rail proximal to the damping device, a first guide groove configured to guide the first limit member out of the first bent segment and into the straight groove segment is provided on the first snap block, and a first protruding block abutted against the first limit member is provided in the first guide groove.

12. The drawer assembly according to claim 11, wherein the first guide groove comprises a first guide segment extended horizontally and a second guide segment connected with the first guide segment and bent in shape.

13. The drawer assembly according to claim 11, wherein the rebound device comprises a slider slidably provided on the fixing bracket and an elastic member connected with the slider, the slider penetrates out of the sliding bracket, and a second snap block abutted against and cooperated with the slider is provided at an end of the inner rail proximal to the damping device.

14. The drawer assembly according to claim 13, wherein the first chute further comprises a second bent segment in communication with an opposite end of the straight groove segment, and a bending direction of the second bent segment is opposite to a bending direction of the first bent segment.

15. The drawer assembly according to claim 14, wherein an abutment surface configured to be abutted against the first limit member is provided at an end of the second snap block distal to the fixing bracket; a first guide surface configured to guide the first limit member from the second bent segment entering the straight groove segment is disposed between the second bent segment and the straight groove segment; and a second guide surface configured to guide the first limit member from the straight groove segment entering the first bent segment is disposed between the straight groove segment and the first bent segment.

16. The drawer assembly according to claim 11, wherein the rebound device further comprises a second limit member rotatably connected to the fixing bracket and extending out of the sliding bracket, a second guide groove provided on the first snap block, and a second protruding block provided on the second guide groove, and the second protruding block is provided with a notch snap-fitted with the second limit member.

* * * * *